United States Patent [19]

Hormadaly

[11] Patent Number: 4,654,166

[45] Date of Patent: Mar. 31, 1987

[54] RESISTOR COMPOSITIONS

[75] Inventor: Jacob Hormadaly, Wilmington, Del.

[73] Assignee: E. I. Du Pont de Nemours and Company, Wilmington, Del.

[21] Appl. No.: 873,940

[22] Filed: Jun. 13, 1986

[51] Int. Cl.[4] ..... H01B 1/06

[52] U.S. Cl. ..... 252/518; 106/1.22

[58] Field of Search ..... 252/518; 338/308, 309, 338/20; 428/697, 702; 106/1.22; 427/126.1, 126.2, 126.3, 216, 217

[56] References Cited

U.S. PATENT DOCUMENTS

| | | | |
|---|---|---|---|
| 4,548,741 | 10/1985 | Hormadaly | 252/518 |
| 4,548,742 | 10/1985 | Hormadaly | 252/518 |
| 4,600,604 | 7/1986 | Suita | 252/518 |

*Primary Examiner*—Josephine L. Barr

[57] ABSTRACT

The invention is directed to a thick film resistor composition comprising a dispersion in organic medium of an admixture of finely divided particles if (a) SnO, $SnO_2$, $Ta_2O_5$ pyrochlore, (b) a specifically described borosilicate glass containing NiO and (c) copper oxide either adsorbed on the solids or in the form of finely divided particles admixed therewith.

5 Claims, No Drawings

RESISTOR COMPOSITIONS

FIELD OF INVENTION

The invention is directed to thick film resistor compositions and especially to such compositions which can be used to make resistors having resistance values in the range of 5k to 100k Ω/□.

BACKGROUND OF THE INVENTION

High stability and low process sensitivity are critical requirements for thick film resistors in microcircuit applications. In particular, it is necessary that resistance (Rav) of a resistor be stable over a wide range of temperature conditions. Thus, the thermal coefficient of resistance (TCR) is a critical variable in any thick film resistor. Because thick film resistor compositions are comprised of a functional (conductive) phase and a permanent binder phase, the properties of the conductive and binder phases and their interactions with each other and with the substrate affect both resistance and TCR.

Heretofore, thick film resistor compositions have usually had a functional phase consisting of noble metal oxides and polyoxides and occasionally base metal oxides and derivatives thereof. However, these materials have had a number of shortcomings when compounded to produce a high resistance film. For example, the noble metals when formulated to obtain suitably low TCR have very poor power handling characteristics. On the other hand, when they are formulated to give good power handling characteristics, the TCR is too negative. Furthermore, when metal oxides such as $RuO_2$ and polyoxides such as ruthenium pyrochlore are used as the conductive phase for resistors, they must be air fired. Consequently, they cannot be used with more economical base metal terminations. Still further, when base materials such as metal hexaborides are used, it has not been possible to formulate them to obtain high resistance values (e.g., ≧30k Ω/□) without degrading their power handling ability.

Among the base metal materials which have been investigated for use in resistors are tin oxide ($SnO_2$) doped with other metal oxides such as $As_2O_3$, $Ta_2O_5$, $Sb_2O_5$ and $Bi_2O_3$. These materials are disclosed in U.S. Pat. No. 2,490,825 to Mochell and also by D. B. Binns in Transactions of the British Ceramic Society, January 1974, Vol. 73, pp. 7–17. However, these materials are semiconductors, i.e, they have very highly negative TCR values. In Canadian Pat. No. 1,063,796, R. L. Whalers and K. M. Merz disclose the use of resistors based upon $SnO_2$ and $Ta_2O_5$ which have very highly negative TCR values at high resistances. In addition, these latter materials require processing temperatures of at least 1,000° C.

More recently, in U.S. Pat. No. 4,548,741, Hormadaly disclosed a new class of thick film resistors based upon a conductive phase containing an admixture of finely divided particles of $SnO_2$ and a pyrochlore corresponding to the formula:

$$Sn^{2+}{}_{2-x}Ta_{y3}Nb_{y2}Sn^{4+}{}_{y1}O_{7-x-y1/2}$$

wherein
$x=0–0.55$
$y_3=0–2$
$y_2=0–2$
$y_1=0–0.5$ and
$y_1+y_2+y_3=2$, the amount of $SnO_2$ being from 20 to 95% by weight of the admixture. These resistors have been especially successful for applications in resistors of 30k Ω/□ to 30M Ω/□. Nevertheless, despite such advances in the resistor art, there exists an unmet need for economical resistor materials which will give small negative TCR values and preferably even slightly positive TCR values in the range of 5k Ω/□ to 100k Ω/□. Such materials are especially needed for high reliability electronic network applications.

SUMMARY OF THE INVENTION

The invention is directed primarily to a thick film resistor composition comprising a dispersion in organic medium of an admixture of finely divided particles of (a) 50–60% wt. of a conductive phase comprising 5–80% wt. of a pyrochlore corresponding to the formula:

$$Sn^{2+}{}_{2-x}Ta_{y3}Nb_{y2}Sn^{4+}{}_{y1}O_{7-x-y1/2}$$

wherein
$x=0–0.55$
$y_3=0–2$
$y_2=0–2$
$y_1=0–0.5$ and
$y_1+y_2+y_3=2$, and
20 to 95% wt. $SnO_2$, basis pyrochlore and $SnO_2$ (b) 50–40% wt. of a borosilicate glass composition which is substantially free of Bi, Cd and Pb comprising by mole %:
  (1) 50–85% of a material selected from the group consisting of 25–50% $B_2O_3$, 15–40% $SiO_2$ and 0.1–5% $SnO_2$ and mixtures thereof and
  (2) 50–15% of a material selected from the group consisting of 10–30% BaO, 0–12% MgO, 1–10% NiO and mixtures thereof, further characterized in that
  (aa) the mole ratio $B_2O_3/SiO_2 \geqq 0.8$ and
  (bb) $\Sigma\ (B_2O_3+SiO_2) \geqq 50$; and (c) 0–10.0% wt. copper oxide adsorbed on the pyrochlore and glass particles, and (d) 0–10.0% wt. finely divided copper oxide particles admixed with the pyrochlore and glass particles, the total copper oxide in (c) and (d) being at least 0.05% wt. but no more than 10.0% wt. basis total solids.

DETAILED DESCRIPTION OF THE INVENTION

A. Pyrochlore

It is clear from x-ray analysis that the above described compounds derived from the system SnO—$SnO_2$—$Ta_2O_5$—$Nb_2O_5$ have pyrochlore-related structures. However, the precise nature of that pyrochlore-related structure has not been determined. Nevertheless, for purposes of convenience in referring to them, the terms "pyrochlore" and "pyrochlore-related compounds" are used interchangeably.

The pyrochlore-related compounds (pyrochlores) themselves are prepared by firing the admixture of finely divided particles of SnO, $SnO_2$ and metal pentoxide at 500° to 1100° C. in a nonoxidizing atmosphere. A firing temperature of 700°–1000° C. is preferred.

A conductive phase suitable for the preparation of thick film resistors which contains the above described pyrochlore can be made by two basic methods. In the first, 5–95% wt. of the powdered pyrochlore is mixed with 95–5% wt. of powdered $SnO_2$ and the admixture is fired to produce a conductive phase. From 20–95% wt. of pyrochlore is preferred.

In the second method for making the conductive phase, an admixture of finely divided SnO, $SnO_2$ and metal pentoxide is formed in which the mole ratio of SnO to metal pentoxide is 1.4–3.0 and the $SnO_2$ is in stoichiometric excess of SnO and metal pentoxide. The $SnO_2$ comprises 5–95% by wt. of the total oxides. This admixture is then fired at 600°–1100° C. by which the pyrochlore is formed as one solid phase and excess $SnO_2$ comprises the second phase of the fired reaction product. As in the case of making the pyrochlore by itself, the preferred firing temperature is 600°–1000° C.

The conductive phases made in these ways are combined with $SnO_2$, inorganic binder and organic medium to form a screen-printable thick film composition. The composition and methods of preparing the pyrochlore components of this invention are disclosed in Hormadaly, U.S. Pat. No. 4,548,741, which is incorporated by reference herein.

B. Glass Binder

The borosilicate glass component of the invention is comprised basically of glass-forming materials and glass-modifying materials. By the term "glass-forming material" is meant a material which upon melting and cooling will form a glass by itself without the addition of other materials. The term "glass-forming material" also includes "conditional" glass-forming materials which become part of the glass network. By conditional glass-forming material is meant material which upon melting and cooling will form a glass only if other metal oxides are present. Despite the fact that the materials in Group A are characterized as "glass formers", this does not mean that they are necessarily functioning as glass formers in these glass compositions. The term refers only to their general characterization in the art as being capable of glass formation under certain circumstances. Suitable glass-forming materials and conditional glass formers are $B_2O_3$, $SiO_2$ and $SnO_2$. All are essential to the compositions of the invention.

The boron-containing glass former must constitute at least 20% of the glass composition in order that the viscosity of the glass be suitable for application in thick film resistor systems. However, it must not exceed 50% and preferably not more than 40% lest the humidity stability of the resistor in which it is used be too low.

Similarly, the silica component must be at least 15% of the glass in order that the glass has satisfactory durability and an appropriate coefficient of expansion for the particular ceramic substrate on which thick film resistor paste is used. Nevertheless, the amount of $SiO_2$ should not exceed 40%. When higher amounts of $SiO_2$ are used, the softening point of the glass may be elevated excessively and the TCR of the resultant resistor becomes too low. In addition, the glass-forming portion of the glass must also contain 0.1–5% $SnO_2$. The $SnO_2$ is added to lower the resistance of the resistor system in which the glass is used. The amount of $SnO_2$ used for this purpose is, however, limited by the comparatively low solubility of $SnO_2$ in glass systems of the type described here. For this reason, it is preferred to use no more than 4% $SnO_2$. Nevertheless, at least 0.5% and preferably 2% $SnO_2$ is needed to lower significantly the resistance of the resistors made from compositions containing this material as inorganic binder.

In addition to the above-described limitations on the amount of each glass former or conditional glass former which can be used, it is essential that the glass-forming materials constitute 50–85% of the glass formulation. Also, the total amount of $B_2O_3$ and $SiO_2$ must themselves constitute at least 50% of the glass composition and 60–70% is preferred. In addition, the mole ratio $B_2O_3/SiO_2$ must be at least 0.8.

Essential glass-modifying materials for use in the invention are BaO, and NiO. The composition must contain 10–30% BaO and preferably 12–30% BaO. At least 10% BaO is needed to obtain a suitably low softening point for the glass, but if more than 30% BaO is used, the coefficient of expansion of the glass becomes excessively high and stability of the glass overall is adversely affected as well.

In addition to the above-described material glass modifications, the composition of the invention may contain up to 12% of oxides of alkaline earth metals having atomic numbers 12–38, i.e., Mg, Ca, Sr and mixtures thereof. It is preferred that they contain 3–10% of such alkaline earth oxides, which, when substituted for some of the BaO, tend to leave the coefficient of expansion less than BaO. Moreover, 1–10% NiO must be in the composition to obtain suitable resistance properties. At least 1% NiO is needed to avoid too high resistance levels in the resistor compositions it is used in and 4% NiO is preferred. On the other hand, if more than 10% NiO is used, the resistors made therefrom exhibit too highly negative TCR values. A maximum level of 8% NiO is preferred for most applications.

Equally important as the concentration of the individual glass modifiers is the total concentration of all glass modifiers which must be within the range of 15–50% and preferably 25–35%.

It will be recognized that the glass compositions of the invention must not contain any materials which are reducible under the nonoxidizing conditions encountered in the use of these glasses in thick film resistor compositions. For this reason, reducible oxides such as $Bi_2O_3$, CdO and PbO must not be present in the composition in any significant amount; that is, they may be present in only very small amounts since the reduced materials therefrom adversely effect the stability of the glass. In addition, the exclusion of these compounds also eliminates any the toxicity which might arise from the presence in the glass of oxides of Pb, Bi and Cd.

It is particularly preferred that the binder be comprised of 95–99.9% by weight of the above-described bismuth-, cadmium- and lead-free glass and 5–0.1% wt. of a metal fluoride selected from the group consisting of $CaF_2$, $BaF_2$, $MgF_2$, $SrF_2$, NaF, LiF, KF and $NiF_2$. The use of such metal fluorides with the frit produces a decrease in resistance of the resistors made therefrom. The metal fluorides can either be incorporated in the frit as described above or they can be added as discrete powders with the frit.

The composition and preparation of the above-described borosilicate glasses are disclosed in Hormadaly U.S. Pat. No. 4,537,703, which is incorporated herein by reference.

C. Copper Oxide

The copper oxide component of the invention can be either $Cu_2O$ or CuO and can be incorporated into the composition of the invention either by adsorption onto the surface of the pyrochlore, $SnO_2$ and/or glass components or it can be incorporated in the form of finely divided particles admixed with the other particulate solids. The two methods of incorporating copper oxide can be used together as well.

When the copper oxide is to be adsorbed, it is incorporated by admixing the pyrochlore and glass solids with a solution of copper ions for a time sufficient to effect adsorption of the copper ions to insure uniform coating and then drying the solids having the adsorbed copper oxide thereon.

A preferred method of adsorbing the copper is to mix the solids with an isopropanol solution of $Cu(NO_3)_2.3H_2O$ containing 2–5% wt. $Cu(NO_3)_2.3H_2O$ and then drying the solids at 120° C. for several hours. The copper oxide thusly adsorbed may be in either the cupric or cuprous form. It will be recognized that other forms of copper which are soluble in polar solvents, such as acetates and formates, can be used as well.

On the other hand, the copper oxide can also be added in the particulate form as $Cu_2O$ simply by admixing it with the other solids.

At least 0.05% wt. copper oxide must be used to obtain any significant technical effect and at least 0.1% is preferred. However, if more than about 10% wt. copper oxide is used in the composition, the stability of the resistors made therefrom tend to be affected adversely. On the order of 5.0% wt. copper oxide is preferred in the manufacture of 5k Ω/□.

It will be recognized that the compositions of the invention are readily blendable in that high resistance and low resistance materials can be admixed to obtain resistors having intermediate resistance values.

D. Organic Medium

The main purpose of the organic medium is to serve as a vehicle for dispersion of the finely-divided solids of the composition in such form that it can readily be applied to a ceramic or other substrate. Thus, the organic medium must first of all be one in which the solids are dispersible with an adequate degree of stability. Secondly, the rheological properties of the organic medium must be such that they lend good application properties to the dispersion.

Most thick film compositions are applied to a substrate by means of screen printing. Therefore, they must have appropriate viscosity so that they can be passed through the screen readily. In addition, they should be thixotropic in order that they set up rapidly after being screened, thereby giving good resolution. While the rheological properties are of primary importance, the organic medium is preferably formulated also to give appropriate wettability of the solids and the substrate, good drying rate, dried film strength sufficient to withstand rough handling and good firing properties. Satisfactory appearance of the fired composition is also important.

In view of all these criteria, a wide variety of inert liquids can be used as organic medium. The organic medium for most thick film compositions is typically a solution of resin in a solvent and frequently a solvent solution containing both resin and thixotropic agent. The solvent usually boils within the range of 130°–350° C.

By far, the most frequently used resin for this purpose is ethyl cellulose. However, resins such as ethylhydroxyethyl cellulose, wood rosin, mixtures of ethyl cellulose and phenolic resins, polymethacrylates of lower alcohols, and monobutyl ether of ethylene glycol monoacetate can also be used.

The most widely used solvents for thick film applications are terpenes such as alpha- or beta-terpineol or mixtures thereof with other solvents such as kerosene, dibutylphthalate, butyl carbitol, butyl carbitol acetate, hexylene glycol, and high boiling alcohols and alcohol esters. Various combinations of these and other solvents are formulated to obtain the desired viscosity and volatility requirements for each application.

Among the thixotropic agents which are commonly used are hydrogenated castor oil and derivatives thereof and ethyl cellulose. It is, of course, not always necessary to incorporate a thixotropic agent since the solvent/resin properties coupled with the shear thinning inherent in any suspension may alone be suitable in this regard.

The ratio of organic medium to solids in the paste dispersions can vary considerably and depends upon the manner in which the dispersion is to be applied and the kind of organic medium used. Normally, to achieve good coverage the dispersions will contain complementally by weight 60–90% solids and 40–10% organic medium.

The pastes are conveniently prepared on a three-roll mill. The viscosity of the pastes is typically within the following ranges when measured at room temperature on Brookfield viscometers at low, moderate and high shear rates:

| Shear Rate ($Sec^{-1}$) | Viscosity (Pa · S) | |
|---|---|---|
| 0.2 | 100–5000 | — |
| | 300–2000 | Preferred |
| | 600–1500 | Most preferred |
| 4 | 40–400 | — |
| | 100–250 | Preferred |
| | 140–200 | Most preferred |
| 384 | 7–40 | — |
| | 10–25 | Preferred |
| | 12–18 | Most Preferred |

The amount and type of organic medium (vehicle) utilized is determined mainly by the final desired formulation viscosity and print thickness.

E. Formulation and Application

In the preparation of the composition of the present invention, the particulate inorganic solids are mixed with the organic medium and dispersed with suitable equipment, such as a three-roll mill, to form a suspension, resulting in a composition for which the viscosity will be in the range of about 100–150 Pa.S at a shear rate of 4 $sec^{-1}$.

In the examples which follow, the formulation was carried out in the following manner:

The ingredients of the paste, minus about 5% organic components equivalent to about 5% wt., are weighed together in a container. The components are then vigorously mixed to form a uniform blend; then the blend is passed through dispersing equipment, such as a three roll mill, to achieve a good dispersion of particles. A Hegman gauge is used to determine the state of dispersion of the particles in the paste. This instrument consists of a channel in a block of steel that is 25 μm deep (1 mil) on one end and ramps up to 0" depth at the other end. A blade is used to draw down paste along the length of the channel. Scratches will appear in the channel where the agglomerates' diameter is greater than the channel depth. A satisfactory dispersion will give a fourth scratch point of 10–18 μm typically. The point at which half of the channel is uncovered with a well dispersed paste is between 3 and 8 μm typically. Fourth scratch measurement of 20 μm and "half-channel" measurements of 10 μm indicate a poorly dispersed suspension.

The remaining 5% consisting of organic components of the paste is then added and the resin content is adjusted to bring the viscosity when fully formulated to between 140 and 200 Pa.S at a shear rate of 4 $sec^{-1}$.

The composition is then applied to a substrate, such as alumina ceramic, usually by the process of screen printing, to a wet thickness of about 30–80 microns, preferably 35–70 microns, and most preferably 40–50 microns. The electrode compositions of this invention can be printed onto the substrates either by using an automatic printer or a hand printer in the conventional manner. Preferably automatic screen stencil techniques are employed using a 200 to 325 mesh screen. The printed pattern is then dried at below 200° C., e.g., about 150° C., for about 5–15 minutes before firing. Firing to effect sintering of both the inorganic binder and the finely divided particles of metal is preferably done in a well ventilated belt conveyor furnace with a temperature profile that will allow burnout of the organic matter at about 300°–600° C., a period of maximum temperature of about 800°–950° C. lasting about 5–15 minutes, followed by a controlled cooldown cycle to prevent over-sintering, unwanted chemical reactions at intermediate temperatures, or substrate fracture which can occur from too rapid cooldown. The overall firing procedure will preferably extend over a period of about 1 hour, with 20–25 minutes to reach the firing temperature, about 10 minutes at the firing temperature, and about 20–25 minutes in cooldown. In some instances total cycle times as short as 30 minutes can be used.

F. Sample Preparation

Samples to be tested for temperature coefficient of resistance (TCR) are prepared as follows:

A pattern of the resistor formulation to be tested is screen printed upon each of ten coded Alsimag 614 1×1" ceramic substrates and allowed to equilibrate at room temperature and then dried at 150° C. The mean thickness of each set of dried films before firing must be 22–28 microns as measured by a Brush Surfanalyzer. The dried and printed substrate is then fired for about 60 minutes using a cycle of heating at 35° C. per minute to 900° C., dwell at 900° C. for 9 to 10 minutes, and cooled at a rate of 35° C. per minute to ambient temperature.

G. Test Procedures

Resistance Measurement and Calculations

The test substrates are mounted on terminal posts within a controlled temperature chamber and electrically connected to a digital ohm-meter. The temperature in the chamber is adjusted to 25° C. and allowed to equilibrate, after which the resistance of each substrate is measured and recorded.

The temperature of the chamber is then raised to 125° C. and allowed to equilibrate, after which the resistance of the substrate is again measured and recorded.

The temperature of the chamber is then cooled to −55° C. and allowed to equilibrate and the cold resistance measured and recorded.

The hot and cold temperature coefficients of resistance (TCR) are calculated as follows:

$$\text{Hot } TCR = \frac{R_{125°C.} - R_{25°C.}}{R_{25°C.}} \times (10{,}000) \text{ ppm/°C.}$$

$$\text{Cold } TCR = \frac{R_{-55°C.} - R_{25°C.}}{R_{25°C.}} \times (-12{,}500) \text{ ppm/°C.}$$

The values of $R_{25°\,C.}$ and Hot and Cold TCR are averaged and $R_{25°\,C.}$ values are normalized to 25 microns dry printed thickness and resistivity is reported as ohms per square at 25 microns dry print thickness. Normalization of the multiple test values is calculated with the following relationship:

$$\text{Normalized Resistance Coefficient of Variance} = \frac{\text{Avg. measured resistance} \times \text{Avg. dry print thickness, microns}}{25 \text{ microns}}$$

The coefficient of variance (CV) is a function of the average and individual resistances for the resistors tested and is represented by the relationship Rav, wherein $$\sigma = \sqrt{\frac{\sum_i (R_i - Rav)^2}{n-1}}$$

$R_i$=measured resistance of individual sample.

$R_{av}$=calculated average resistance of all samples ($\Sigma_i R_i/n$)

n=number of samples

CV=($\sigma$/R)×100 (%)

EXAMPLES

In the following examples, several components are used throughout which have the compositions indicated below.

A. Pyrochlore and Conductive Phase

The pyrochlore component of the conductive phase had the composition $Sn^{2+}{}_{1.75}Ta_{1.75}Sn^{4+}{}_{0.25}O_{0.625}$ and was prepared in accordance with the procedure described in Hormadaly U.S. Pat. No. 4,548,741. Two conductive phases were used in the examples as follows:

| Conductive A | Conductive B |
|---|---|
| 20% wt. pyrochlore | 10% wt. pyrochlore |
| 80% wt. $SnO_2$ | 90% wt. $SnO_2$ |

B. Borosilicate Glass

Two glasses were used in the Examples, the compositions of which are given in Table 1 below.

TABLE 1

| Inorganic Binder Compositions | | |
|---|---|---|
| Glass Designation | A | B |
| Composition | Mole %, oxide basis | |
| BaO | 18.3 | 17.2 |
| CaO | 9.5 | 8.9 |
| $SiO_2$ | 32.6 | 30.2 |
| $B_2O_3$ | 37.1 | 34.4 |

TABLE 1-continued

| Inorganic Binder Compositions | | |
|---|---|---|
| Glass Designation | A | B |
| Composition | Mole %, oxide basis | |
| $SnO_2$ | 2.5 | 2.3 |
| NiO | — | 7.0 |

C. Organic Medium

The organic media used in the Examples were each comprised of dibutyl carbitol, α,β-terpineol and ethyl cellulose. Particular media compositions and component blends were as follows:

| Designation | OM-1 | OM-2 | OM-3 |
|---|---|---|---|
| Dibutyl Carbitol | 60 | 40.9 | 66.7 |
| α, β-terpineol | 30 | 46.7 | 33.3 |
| Ethyl cellulose | 10 | 12.4 | — |

Example 1

Adsorption of Copper Oxide on Conductive Phase

Copper oxide was adsorbed onto to Conductive A by admixing 50 g of Conductive A into a solution of 1.53 g $Cu(NO_3)_2.3H_2O$ in 50 g isopropyl alcohol. The admixture was maintained at room temperature for several hours to effect adsorption of the copper oxide and evaporation of the solvent. The remaining solids were then dried in an oven overnight at 120° C. to bring about substantially complete removal of the solvent.

Examples 2 and 3

A quantity of Conductive A having no adsorbed copper thereon and the above Conductive A material having adsorbed copper oxide thereon were formulated in the same manner to form thick film pastes which were used to make resistors. In the formulation of these pastes the samples were roll milled at 0, 50, 100, 150 and 200 psi. The composition of the thick film formulation and the properties of the resistors made therefrom are given in Table 2 below.

TABLE 2

| Effect of Copper Oxide Adsorption On Resistor Properties | | |
|---|---|---|
| Example No. | 2 | 3 |
| Formulation | % wt. | |
| Conductive A (No adsorbed CuO) | 52.0 | — |
| Conductive A (3% Adsorbed CuO) | — | 52.0 |
| Glass A | 23.9 | — |
| Glass B | — | 23.9 |
| $CaF_2$ | 0.1 | 0.1 |
| OM-1 | 13.0 | 13.0 |
| OM-2 | 5.0 | 5.0 |
| OM-3 | 6.0 | 6.0 |
| Electrical Properties | | |
| Rav, KΩ/□/mil | 53.2 | 10.3 |
| CV, % | 3.4 | 6.1 |
| HTCR, ppm/°C. | −20.4 | −18.3 |
| CTCR, ppm/°C. | +22.9 | +33.5 |

The data in Table 2 show that the adsorption of copper oxide on the conductive solids lowered the resistance substantially without incurring any significant degradation of either CV or TCR.

Example 4

A larger quantity of Conductive A having copper oxide adsorbed thereon was prepared by admixing 200 g of Conductive A into a solution of 6.12 g $Cu(NO_3)_2.3H_2O$ in 200 g isopropyl alcohol and drying it in the same manner as Example 1 except that oven drying was at 110° C.

This conductive phase was then formulated to form a thick film paste and resistors were made therefrom. The composition of the paste and the properties of the resistors made therefrom are given in Table 3 below.

TABLE 3

| Properties of Resistors Having Adsorbed Copper Oxide | |
|---|---|
| Example No. | 4 |
| Formulation | % wt. |
| Conductive A | 52 |
| Glass B | 23.9 |
| $CaF_2$ | 0.1 |
| OM-1 | 13.0 |
| OM-2 | 5.0 |
| OM-3 | 6.0 |
| Electrical Properties | |
| Rav, KΩ/□/mil | 22.6 |
| CV, % | 2.3 |
| HTCR, ppm/°C. | −90.6 |
| CTCR, ppm/°C. | −110.0 |

The data in Table 3 show again the effect of adsorbed copper oxide in lowering resistance substantially while maintaining satisfactory CV and TCR properties.

Examples 5–7

Three further thick film compositions were made in which the copper oxide was added as a discrete particulate instead of by adsorption. The composition of the pastes and the properties of the resistors made therefrom are given in Table 4 below.

TABLE 4

| Resistor Properties With Particulate Addition of Copper Oxide | | | |
|---|---|---|---|
| Example No. | 5 | 6 | 7 |
| Formulation | | % wt. | |
| Conductive B | 52.0 | — | — |
| Conductive A | — | 52.0 | 52.0 |
| Glass B | 21.4 | 21.4 | 21.4 |
| Copper Oxide | 0.5 | 0.5 | 0.5 |
| $CaF_2$ | 0.1 | 0.1 | 0.1 |
| OM-1 | 15.0 | 15.0 | 15.0 |
| OM-2 | 5.0 | 5.0 | 5.0 |
| OM-3 | 5.9 | 5.9 | 5.9 |
| Phenolic Resin | 0.1 | 0.1 | 0.1 |
| Electrical Properties | | | |
| Rav, KΩ/□/mil | 9.3 | 6.4 | 19.3 |
| CV, % | 3.0 | 2.3 | 4.7 |
| HTCR, ppm/°C. | 7.0 | 171.6 | −46.5 |
| CTCR, ppm/°C. | −66.3 | 242.0 | −37.7 |

The above data show that the addition of copper oxide powder is similarly effective to the adsorption of copper oxide in producing resistors having lower resistance values. The Example 6 Conductive was produced on a plant scale while the Example 7 Conductive was produced in the laboratory. It will be noted that Conductive A differs from Conductive B in that it contains twice as much pyrochlore (20% v. 10% wt.).

Examples 8–10

Here, the pastes of Examples 5 and 7 were blended in various proportions to observe whether compositions of the invention which yield resistors having divergent properties could be blended to make resistors having intermediate properties. The properties of the resistors made from such blends as well as the properties of the Example 5 and 7 formulations are given in Table 5 below.

TABLE 5

Blending of Resistor Paste Compositions

| Example No. | 5 | 8 | 9 | 10 | 7 |
|---|---|---|---|---|---|
| Example 5 Paste, % wt. | 100 | 75 | 50 | 25 | — |
| Example 7 Paste, % wt. | — | 25 | 50 | 75 | 100 |
| Electrical Properties | | | | | |
| Rav, KΩ/□/mil | 9.3 | 10.6 | 12.4 | 15.1 | 19.3 |
| CV, % | 3.0 | 3.5 | 5.8 | 4.9 | 4.7 |
| HTCR, ppm/°C. | 7.0 | 35.8 | +3.0 | −31.2 | −46.5 |
| CTCR, ppm/°C. | −66.3 | 29.0 | +44.9 | +42.2 | −37.7 |

The above data show that the two compositions blended quite rationally. Thus, two compositions which produce resistors having widely divergent electrical properties can indeed be blended to produce resistors having intermediate properties.

Example 11

In this Example, a paste was prepared incorporating copper oxide by particulate addition which resulted in resistors having resistance values below 5K. The thick film paste consisted of 52.0% wt. Conductive B, 16.9% wt. Glass B, 5.0% wt. copper oxide, 0.1% $CaF_2$ and the same proportions of organic media as in Examples 5–7. The resistors made from this paste had the following properties:

| | |
|---|---|
| R, KΩ/□/mil | 4.6 |
| CV, % | 4.3 |
| HTR, ppm °C. | +144.7 |
| CTCR, ppm/°C. | +70.8 |

Examples 12–14

The pastes of Examples 5 and 11 were blended in various proportions to observe their blending characteristics. The properties of the resistors made therefrom are given in Table 6 below.

TABLE 6

Blending of Resistor Paste Compositions

| Example No. | 5 | 12 | 13 | 14 | 11 |
|---|---|---|---|---|---|
| Example 5 Paste, % wt. | 100 | 75 | 50 | 25 | — |
| Example 11 Paste, % wt. | — | 25 | 50 | 75 | 100 |
| Electrical Properties | | | | | |
| Rav, KΩ/□/mil | 9.3 | 6.5 | 5.9 | 5.2 | 4.6 |
| CV, % | 3.0 | 1.7 | 2.5 | 2.9 | 4.3 |
| HTCR. ppm/°C. | 7.0 | +100.8 | +98.3 | +85.5 | +144.7 |
| CTCR, ppm/°C. | −66.3 | +114.1 | +114.4 | +120.7 | +70.8 |

The data in Table 6 show that the pastes blended quite rationally with respect to resistance values.

Examples 15–17

In these examples, three resistor pastes were formulated to show the effect of copper oxide paste concentration on the properties of resistors made therefrom. The pastes were blends of the Example 6 paste containing only 0.5% wt. copper oxide with various amounts of the Example 11 paste which contained 5.0% wt. copper oxide.

TABLE 7

Blending of Resistor Paste Compositions

| Example No. | 6 | 15 | 16 | 17 | 11 |
|---|---|---|---|---|---|
| Example 5 Paste, % wt. | 100 | 75 | 50 | 25 | — |
| Example 11 Paste, % wt. | — | 25 | 50 | 75 | 100 |
| Copper Oxide | 0.5 | 1.6 | 2.8 | 3.9 | 5.8 |
| Electrical Properties | | | | | |
| Rav, KΩ/□/mil | 6.4 | 7.0 | 6.9 | 5.7 | 4.6 |
| CV, % | 2.3 | 1.9 | 3.5 | 2.0 | 4.3 |
| HTCR, ppm/°C. | +171.6 | +165.4 | +152.5 | +126.5 | +144.4 |
| CTCR, ppm/°C. | +242.0 | +178.4 | +161.2 | +110.4 | +70.8 |

These data show that resistance values of similar copper oxide containing pastes have an inverse relationship to the concentration of copper oxide.

Examples 18 and 19

Two Conductive A pastes were prepared in which the copper oxide was incorporated by adsorption onto the surface of the conductive phase. In the first (Example 18), the copper oxide was adsorbed by slurrying 400 g of the conductive phase in a solution of 12.24 g $Cu(NO_3)_2.3H_2O$ in 400 g of isopropyl alcohol. In the second (Example 19), the copper oxide was adsorbed by slurrying 400 g of the conductive phase in a solution of 12.24 g of $Cu(NO_3)_2.3H_2O$ in 400 g of water. Both conductive materials were dewatered by oven drying at 120° C. for 48 hours.

Both of the conductive phases were then formulated into thick film pastes which were formed into resistors.

The composition of the pastes and the properties of the resistors prepared therefrom are given in Table 8 below.

TABLE 8

| Effect of Adsorption Method On Resistor Properties | | |
|---|---|---|
| Example No | 18 | 19 |
| Composition | % wt. | |
| Conductive A | 52.0 | 52.0 |
| Adsorbate solvent | isopropyl alcohol | water |
| Glass B | 21.9 | 21.9 |
| $CaF_2$ | 0.1 | 0.1 |
| OM-1 | 15.0 | 15.0 |
| OM-2 | 5.0 | 5.0 |
| OM-3 | 6.0 | 6.0 |
| Electrical Properties | | |
| Rav, KΩ/□/mil | 7.4 | 6.8 |
| CV, % | 3.7 | 0.8 |
| HTCR, ppm/°C. | +157.7 | +156.2 |
| CTCR, ppm/°C. | +226.4 | +224.8 |

The above data show that the two methods of adsorption are quite comparable in their effectiveness.

I claim:

1. A thick film resistor composition comprising a dispersion in organic medium of an admixture of finely divided particles of:

(a) 50–60% wt. of a conductive phase comprising 5–80% wt. of a pyrochlore corresponding to the formula $$Sn^{2+}{}_{2-x}Ta_{y3}Nb_{y2}Sn^{4+}{}_{y1}O_{7-x-y1/2}$$

wherein $x=0–0.55$ $y_3=0–2$ $y_2=0–2$ $y_1=0–0.5$ and $y_1+y_2+y_3=2$, 95 to 20% wt. $SnO_2$, basis pyrochlore and $SnO_2$, (b) 50–40% wt. of a borosilicate glass composition which is substantially free of Bi, Cd and Pb comprising by mole %

(1) 50–85% of a material selected from the group consisting of 25–50% $B_2O_3$, 15–40% $SiO_2$ and 0.1–5% $SnO_2$ and mixtures thereof, and (2) 50–15% of a material selected from the group consisting of 10–30% BaO, 0–12% MgO, 1–10% NiO and mixtures thereof, further characterized in that (aa) the mole ratio of $B_2O_3/SiO_2 \geqq 0.8$; and (bb) $\Sigma\ (B_2O_3+SiO_2) \geqq 50$; and (c) 0–10.0% wt. copper oxide adsorbed on the pyrochlore and glass particles; and (d) 0–10.0% wt. finely divided copper oxide particles admixed with the pyrochlore and glass particles, the total copper oxide in (c) and (d) being at least 0.05% wt. but no more than 10.0% by wt. basis total solids.

2. The composition of claim 1 in which the copper oxide is adsorbed on the pyrochlore, $SnO_2$ and glass particles.

3. The composition of claim 2 in which the copper oxide was admixed from a solution of $Cu(NO_3)_2$ and polar solvent.

4. The composition of claim 1 which contains copper oxide particles admixed therewith.

5. A resistor comprising a patterned thin layer of the composition of claim 1 which has been fired in a nonoxidizing atmosphere to effect volatilization of the organic medium and liquid phase sintering of the glass.

* * * * *